United States Patent [19]

Mazurek

[11] Patent Number: 4,969,412

[45] Date of Patent: Nov. 13, 1990

[54] REPAIR AND STRUCTURAL REINFORCEMENT OF THE HANDLE POLE OF A JET WATER SKI

[76] Inventor: John D. Mazurek, P.O. Box 585, Vista, Calif. 92083

[21] Appl. No.: 389,774

[22] Filed: Aug. 4, 1989

[51] Int. Cl.[5] ..... B63B 35/00

[52] U.S. Cl. ..... 114/270; 16/111 R

[58] Field of Search ..... 114/270, 144 R, 211; 74/480 B, 551.1, 551.3, 551.6, 551.7; 16/111 R, 111 A, 112; 440/88; 180/19.1, 19.3

[56] References Cited

U.S. PATENT DOCUMENTS

| | | | |
|---|---|---|---|
| 4,688,508 | 8/1987 | Nishida | 114/270 |
| 4,733,627 | 3/1988 | Nishida | 114/270 |
| 4,748,928 | 6/1988 | Nakamura | 114/270 |

*Primary Examiner*—Sherman Basinger

*Assistant Examiner*—Jesus D. Sotelo

*Attorney, Agent, or Firm*—Kenneth W. Float; Noel B. Hammond

[57] ABSTRACT

Two different embodiments of a kit for structurally reinforcing the handle pole for a jet water ski to make it stronger than new are disclosed. The kit includes two internal reinforcing members and two external clamping members. The internal and external member are made of an impact-resistant material such as fracture-resistant plastic, high-density aluminum or stainless steel. The internal and external members are also corrosion resistant. An epoxy cement or glue provides a flat foundation, acts as a cushion against impact and tends to prevent cracking. The internal members have a bend that acts as a suspension system, and orients journal bearing holes transverse to a main mounting bolt. The internal and external members are attached where the handle pole wall is strongest.

21 Claims, 3 Drawing Sheets

REPAIR AND STRUCTURAL REINFORCEMENT OF THE HANDLE POLE OF A JET WATER SKI

BACKGROUND

The present invention relates to repair and structural reinforcement for the handle pole of a jet ski personal watercraft, and more particularly, to a kit providing high strength reinforcement for the handle pole mounting point for a jet ski watercraft.

The handle pole for a jet ski watercraft may last as long as three years if the watercraft is used on calm inland lakes and rivers, and is subject only to gentle family or personal usage. However, if a watercraft is used in rough ocean waters by an aggressive rider, particularly in competition, the handle pole is more likely to develop stress cracks and break. Heretofore, when the handle pole shows signs of wear or breaks, it has been necessary to replace the entire handle pole at considerable expense.

Therefore, it is a feature of the present invention to provide a quality high-strength repair and structural reinforcement kit for the handle pole mounting point.

It is another feature of the present invention to provide a repair and structural reinforcement kit for the mounting pole of a jet watercraft that may be installed in about thirty minutes.

A further feature of the invention is the provision of a repair and structural reinforcement kit that makes damage handle poles stronger than new handle poles, and at about ⅓ the cost of replacement.

SUMMARY OF THE INVENTION.

In accordance with these and other features and advantages of the present invention, there is provided a handle pole repair of structural reinforcement kit that may be installed without removing any switches or cables. The kit includes four reinforcement plates. Two plates are internal reinforcement braces and two are external clamping members. The braces are made of high density aircraft aluminum and are available in anodized colors. The external clamping members are made of stainless steel. All the hardware for the kit is stainless steel. A waterproof epoxy cement is also used in the assembly. The assembly is both strong and resilient, providing a means to strongly retain yet adequately cushion the pole under severe stress conditions.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
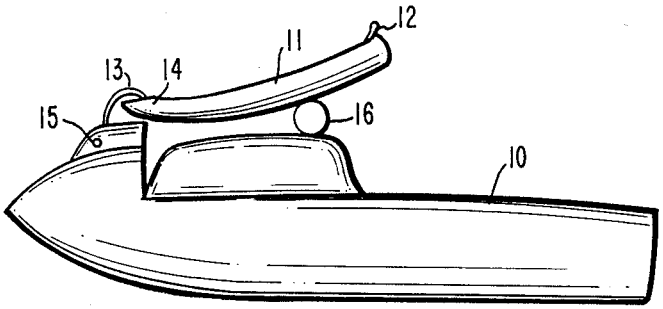
FIG. 1 illustrates a jet ski watercraft, showing the handle pole upside-down in position for installation of the reinforcement kit of the present invention.

Referring now to FIG. 1 of the drawings, there is shown a jet ski watercraft 10 having a handle pole 11 with which the rider controls the watercraft 10. The handle pole 11 is provided with switches 12 and cables 13 which enable the rider to control speed and direction.

The handle pole 11 is made of thin-walled fiberglass and is formed into a contoured elongated channel having a mounting point 14 which mounts to the jet ski watercraft 10 by means of a pivot hole 15. FIG. 1 shows the handle pole 11 dismounted from the pivot hole 15 and turned over upside down to rest on a support 16. The handle pole 11 must be supported to prevent kinking or damaging the steering cables 13. With the handle pole 11 upside down and resting on the support 16, it is in position for installation of the repair of reinforcement kit of the present invention. In this manner, the kit may be installed in the handle pole 11 without removing any switches 12 or cables 13.

Figure 2:
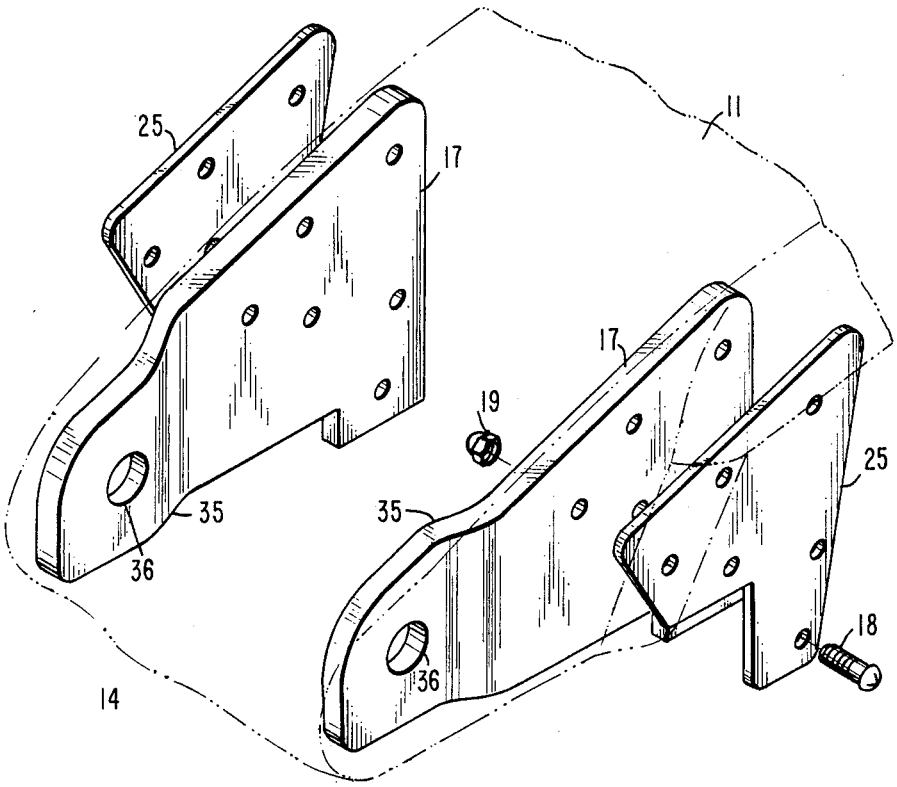
FIG. 2 is an exploded perspective view showing placement of internal braces and external clamping members in relation to the mounting end of the handle pole.

Referring now to FIG. 2, there is shown an exploded perspective view of the handle pole 11. The handle pole 11 is shown in phantom right-side up, and only the end of the handle pole 11 having the mounting point 14 is shown. This view shows the placement of the parts in the kit for repair and structural reinforcement of the handle pole 11.

There are provided two internal reinforcing members or handle pole braces 17, and two external clamping members 25. The wall of the handle pole 11 is clamped between the braces 17 and the clamping members 25 by means of fasteners such as screws 18 and locknuts 19. The handle pole braces 17 are made of impact-resistant material such as high density aircraft aluminum or fracture resistant plastic. The material should not only be fracture resistant or impact resistant, it should also be corrosion resistant. When aluminum is used, the aluminum should be anodized. The clamping members 25 do not need to be as thick as the braces 17 and are made of fracture resistant material such as stainless steel or plastic. The hardware items such as screws 18 and locknuts 19 are made of stainless steel.

Figure 3:
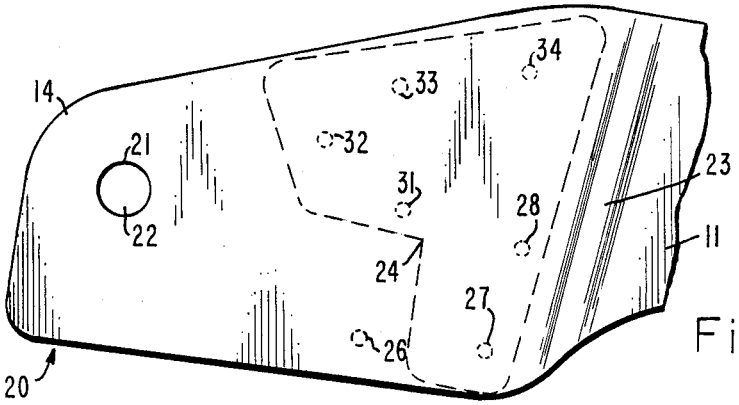
FIG. 3 is a side view of the mounting end of the handle pole outlining the position of the external clamping member.

FIG. 3 is a side view of the mounting point 14 of the handle pole 11. In this view, the handle pole 11 is shown rightside up. For clarity, the cables 13 are not illustrated. It will be understood that the handle pole 11 is cast or formed as a hollow channel, and that the cables 13 normally exit by an opening or mouth 20 at the end of the handle pole 11. As may be seen in FIG. 3, the handle pole 11 is contoured in the region of the mounting point 14 to taper to a mounting knuckle 21 having an opening 22 adapted for mounting the handle pole 11 to the pivot hole 15 (shown in FIG. 1) in the watercraft 10. The flat face of the handle pole 11 in the region of the mounting point 14 and the knuckle 21 extends to meet strengthening ridges 23 on the exterior surface of the handle pole 11.

A broken line 24 outlines the position of the clamping member 25 which are installed on the exterior surface of the handle pole 11. There are three existing screw holes 26, 27, 28 on each side of the handle pole 11, and four new screw holes 31, 32, 33, 34 must be added in the locations indicated in FIG. 3.

The assure precise alignment of the new holes 31–34, the clamping members 25 are placed in position as indicated by the broken line 24. Screws 18 are inserted in holes 27 and 28, through the clamping members 25, the side walls of the handle pole 11, and the pole braces 17. Nuts 19 are fastened loosely on the inside of the handle pole 11. The clamping members 25 are aligned to the strengthening ridges 23 and the new holes 31–34 are drilled in the following order: 32, 34, 33, and 31.

Figure 4:
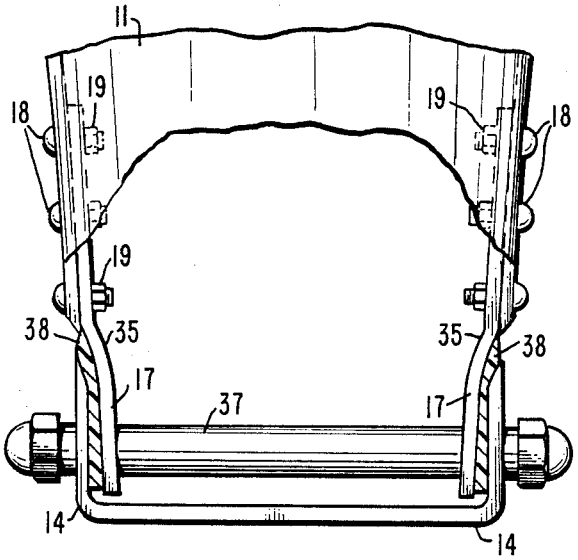
FIG. 4 is a view showing the handle pole turned upside-down with the reinforcing braces installed in the interior, and showing the main pivot mounting pin installed.

Referrng now to FIG. 4 of the drawings, there is illustrated a view of the handle pole 11 upside down looking down into the mouth 20 in the region of the mounting point 14. The handle pole braces 17 are shown disposed within the handle pole 11 and in intimate contact with the interior wall thereof. As may be seen in FIG. 2 and in FIG. 4, the handle pole braces 17 have a bend 35 provided therein. This bend 35 brings the end of the handle pole brace 17 away from the wall of the handle pole 11 at the end where it has a hole 36 which serves as a bearing journal for a main mounting bolt 37. This main mounting bolt 37 passes through the hole 22 in the side walls of the handle pole 11 at the knuckle 21. The bend 35 permits the handle pole braces 17 to cross the main mounting bolt 37 at substantially a right angle. Furthermore, the bend 35 permits the handle pole braces 17 to act as a suspension system for the handle pole 11.

In installing the handle pole braces 17, any excess dried glue or other material is removed from the inside of the handle pole 11 that would prevent the inner handle pole braces 17 from laying flat against the inner surface of handle pole 11. The inside of the handle pole 11 should be clean of grease and dirt. Also, the handle pole braces 17 should also be clean of grease and dirt. A layer of water-proof epoxy cement 38 such as that known by the trade name "Liquid Nails" or "Poxy Putty" is applied to the inside wall of the handle pole 11. After the epoxy cement 38 is mixed, it is spread on the pole braces 17, and an ample amount is also put inside the handle pole 11 in the low spots and where the pole braces 17 make contact. The epoxy cement 38 acts as a cushion against impact. Also, the epoxy cement 38 forms a bond and a flat foundation for the handle pole braces 17. It has been found that if the epoxy cement 38 is not used, cracks that have appeared in the handle pole 11 tend to run farther back up the handle pole 11. Another purpose of the epoxy cement 38 is to prevent vibration of the handle pole braces 17. It is important that the main mounting bolt 37 be in place for final tightening after the epoxy cement 38 is applied.

It will be found that when this kit has been applied to a handle pole 11, it will then be stronger than a new unit. The location where the clamping members 25 are fastened to the pole braces 17 is where the fiberglass structure of the handle pole 11 is strongest. Because the screws 18 are operating in shear, this structural reinforcement is more than adequate to support the loads. The holes 36 in the handle pole braces 17 act as heavy duty bearing journals to hold the main mounting bolt 37. The handle pole brace 17 acts as a suspension system because of the bend 35 which has a spring to it. The lock nuts 19 are self locking and remain tight. The epoxy cement 38 serves as a cushion and a flat foundation for the handle pole brace 17, and because of the cement 38, the handle pole brace 17 is not free to vibrate. Because the handle pole braces 17 are made of impact resistant material, the structurally reinforced handle pole 11 is not subject to cracking or breaking even when used on a jet ski in rough ocean water by an aggressive rider.

Figure 5:
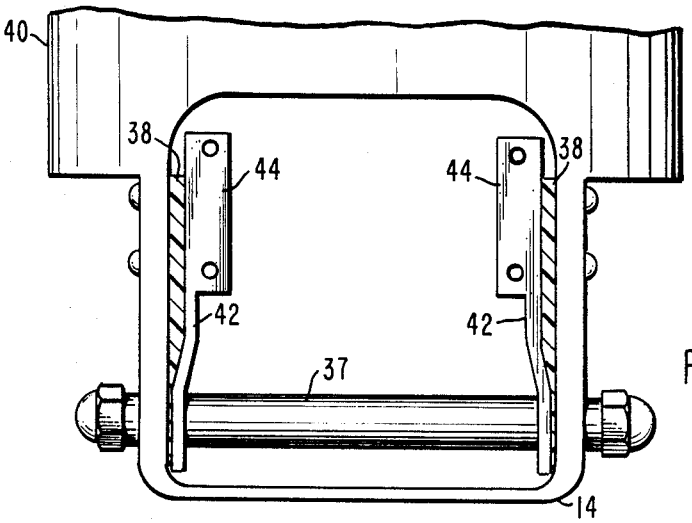
FIG. 5 is a view of a different model of handle pole turned upside-down with the reinforcing braces installed in the interior, and showing the main pivot mounting pin installed.

Referring now to FIG. 5 of the drawings, there is illustrated a second embodiment of the kit of the present invention employed with a different model of handle pole 40. In this arrangement, the external clamping members 41 are located on top of the handle pole 40. In the interior of the handle pole 40, the internal handle pole braces 42 are provided with a right angle bend 43 that results in a mounting flange 44. This mountig flange 44 fits flat against the interior of the top of the handle pole 40.

Figure 6:
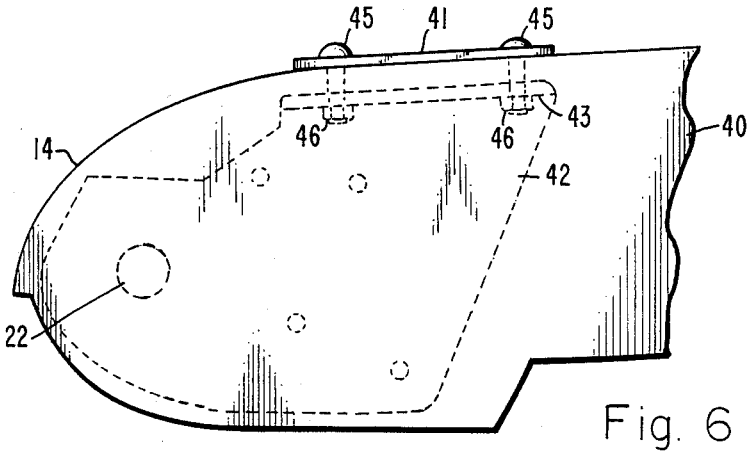
FIG. 6 is a side view of the handle pole of FIG. 5 turned right-side-up showing the internal braces and external clamping members installed.
Figure 7:
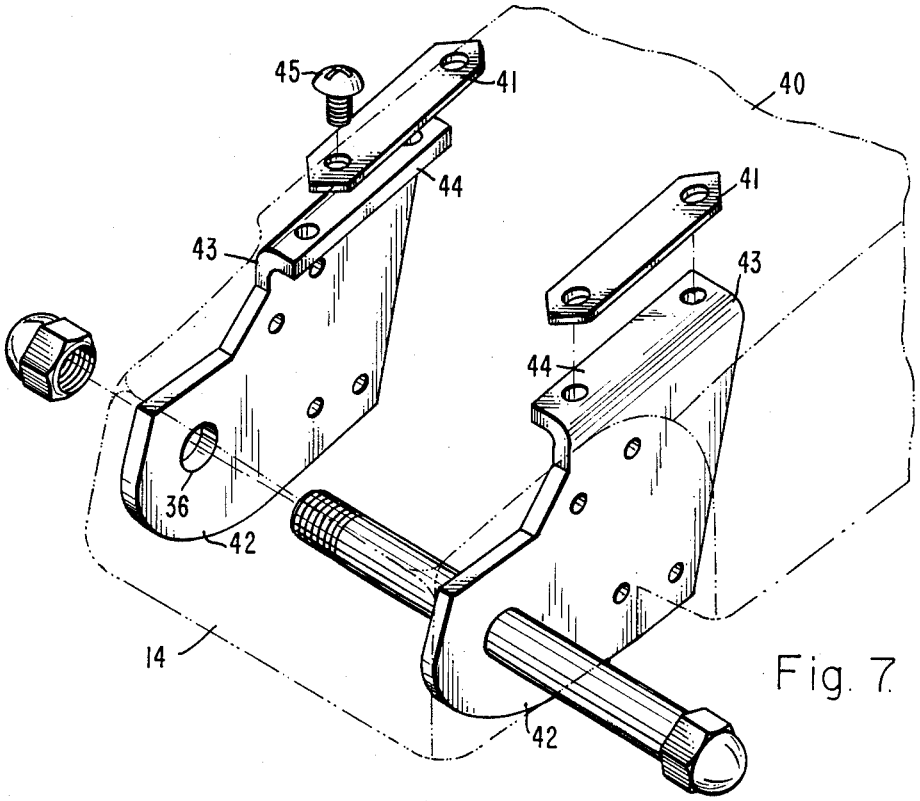
FIG. 7 is an exploded perspective view of the handle pole of FIGS. 5 and 6 showing placement of internal braces and external clamping members in relation to the mounting end of the handle pole.

Referring now to FIGS. 6 and 7, it may be seen that the upper wall of the handle pole 40 is clamped between the clamping members 41 and the mounting flanges 44. This is done by means of fasteners such as screws 45 and lock nuts 46. The screws 18 and lock nuts 19 that hold the handle pole braces 42 on the sides are mounted in the same manner as in the embodiment of FIGS. 2, 3 and 4. The main mounting bolt 37 passes thorugh the hole 36 in the handle pole brace 42 and through the opening 22 at the knuckle 21 of the handle pole 40.

The location where the clamping members 41 are fastened to the pole braces 42 is where the fiberglass structure of the handle pole 40 is strongest. Because the screws 45 are operating in shear, this structural reinforcement is more than adequate to support the loads.

Thus there has been described two embodiments of new and novel repair and structural reinforcement kits for the handle pole of a jet ski watercraft. These kits provides high strength reinforcement for the handle pole mounting point. The kits are easy to install without removing any switches and cables in thirty minutes. A structurally reinforced handle pole is stronger than new and easily resists impacts that cause cracking, breaking and fractures. The kits are made of materials that are impervious to corrosion.

It is to be understood that the above-described embodiments are merely illustrative of some of the many specific embodiments which represent applications of the principles of the present invention. Clearly, numerous and other arrangements can be readily devised by those skilled in the art without departing from the scope of the invention. For example, other structural reinforcement members may be made for new models of handle poles by employing the principles of the present invention.

What is claimed is:

1. A reinforcing kit for the handle pole of a jet ski watercraft, said handle pole being made of thin-wall fiberglass configured to defined a channel terminating in a mounting knuckle having openings adapted to receive a main pivot mounting pin, said reinforcing kit comprising:

a pair of handle pole braces for disposition within and in intimate contact with the interior of said channel defined by said handle pole, said handle pole braces being adapted to extend along the interior wall of said channel, said handle pole braces being contoured to substantially match the interior configuration of said channel, said handle pole braces each having an opening to provide a bearing journal for said main pivot mounting pin.

2. The reinforcing kit in accordance with claim 1 in which said handle pole braces are made of high-density aluminum.

3. The reinforcing kit in accordance with claim 2 in which said handle pole braces are anodized.

4. The reinforcing kit in accordance with claim 1 which further comprises:

a pair of external clamping members for disposition outside of and in intimate contact with the exterior surfaces of said handle pole, said external clamping members having a configuration adapted to substantially match the external contours of said handle pole.

5. The reinforcing kit in accordance with claim 4 in which said external clamping members are adapted to overlay at least a portion of said handle pole braces, and in which holes are provided for fasteners to pass through said handle pole braces, said handle pole and said external clamping members, whereby force may be applied to compress the walls of said handle pole between said handle pole braces and said external clamping members.

6. A reinforced arrangement for mounting a handle pole member onto a jet ski watercraft comprising:

an elongated handle pole member made of thin-wall fiberglass configured to define a channel terminating in a tapered mounting knuckle having openings adapted to receive a main pivot mounting pin;

a pair of internal reinforcing members made of high-density aluminum, each of said internal reinforcing members being disposed within and in intimate contact with the interior of said channel defined by said pole member, one of said internal reinforcing members extending along the interior wall on one side of said channel, the other of said internal reinforcing members extending along the opposite interior wall on the other side of said channel, said internal reinforcing members being tapered and contoured to match the interior configuration of said channel, said internal reinforcing members each having an opening providing a bearing journal for said main pivot mounting pin;

a pair of external clamping members made of stainless steel, each of said external clamping members being disposed outside of and in intimate contact with the exterior surfaces of said pole member, said external clamping members having a substantially flat notched triangular configuration adapted to match the external contours of said pole member;

a layer of waterproof epoxy adhesive disposed between said internal reinforcing members and the interior walls of said channel defined by said pole member;

a plurality of stainless steel fasteners extending through said external clamping members, said walls of said pole member, said layer of waterproof epoxy adhesive, and said internal reinforcing members, said stainless steel fasteners applying force to compress said layer of waterproof epoxy adhesive and said walls of said pole member between said external clamping members and said internal reinforcing members, whereby said openings in said internal reinforcing members providing a bearing journal for said main pivot mounting pin and said pole member act as one integral unit; and a stainless steel main pivot mounting pin disposed in said tapered mounting knuckle passing through said internal reinforcing members for pivotably mounting said pole member onto a jet ski watercraft.

7. A reinforced arrangement for mounting a handle pole member onto a jet ski watercraft comprising:

an elongated handle pole member made of thin-wall fiberglass configured to define a channel terminating in a mounting knuckle having openings adapted to receive a main pivot mounting pin;

a pair of internal reinforcing members made of high-density aluminum, each of said internal reinforcing members being disposed within and in intimate contact with the interior of said channel defined by said pole member, said internal reinforcing members extending along the interior wall of said channel, said internal reinforcing members being tapered and contoured to match the interior configuration of said channel said internal reinforcing members each having an opening providing a bearing journal for said main pivot mounting pin;

a pair of external clamping members made of stainless steel, each of said external clamping members being disposed outside of and in intimate contact with the exterior surfaces of said pole member, said external clamping members having a substantially flat configuration adapted to match the external contours of said pole member;

a layer of waterproof epoxy adhesive disposed between said internal reinforcing members and the interior walls of said channel defined by said pole member;

a plurality of stainless steel fasteners extending through said walls of said pole member, said layer of waterproof epoxy adhesive, and said internal reinforcing members, said stainless steel fasteners applying force to compress said layer of waterproof epoxy adhesive, said walls of said pole member and said internal reinforcing members together, whereby said openings in said internal reinforcing members providing a bearing journal for said main pivot mounting pin and said pole member act as one integral unit; and a stainless steel main pivot mounting pin disposed in said mounting knuckle passing through said internal reinforcing members for pivotably mounting said pole member onto a jet ski watercraft.

8. A reinforced arrangement for mounting a handle pole member onto a jet ski watercraft, said handle pole member being made of thin-wall fiberglass configured to define a channel terminating in a tapered mounting knuckle having openings adapted to receive a main pivot mounting pin, said reinforced arrangement comprising:

a pair of internal reinforcing members disposed within and in intimate contact with the interior of said channel defined by said pole member, one of said internal reinforcing members extending along the interior wall on one side of said channel, the other of said internal reinforcing members extending along the opposite interior wall on the other side of said channel, said internal reinforcing members being contoured to match the interior configuration of said channel, said internal reinforcing members each having an opening providing a bearing journal for said main pivot mounting pin;

a pair of external clamping members disposed outside of and in intimate contact with the exterior surfaces of said pole member, said external clamping members having a configuration adapted to match the external contours of said pole member;

a layer of adhesive disposed between said internal reinforcing members and the interior walls of said channel defined by said pole member;

a plurality of fasteners extending through said external clamping members, said walls of said pole member, said layer of adhesive, and said internal reinforcing members, said fasteners applying force to compress said layer of adhesive and said walls of said pole member between said external clamping members and said internal reinforcing members, whereby said openings in said internal reinforcing members providing a bearing journal for said main pivot mounting pin and said pole member act as one integral unit; and a main pivot mounting pin disposed in said mounting knuckle passing through said internal reinforcing members for pivotably mounting said pole member onto the jet ski watercraft.

9. The reinforced arrangement of claim 8 in which said internal reinforcing members are made of high-density aluminum.

10. The reinforced arrangement of claim 8 in which said external clamping members are made of stainless steel.

11. The reinforced arrangement of claim 8 in which said external clamping members have a substantially flat notched triangular configuration.

12. The reinforced arrangement of claim 8 in which said adhesive is a waterproof epoxy.

13. The reinforced arrangement of claim 8 in which said fasteners are made of stainless steel.

14. The reinforced arrangement of claim 8 in which said main pivot mounting pin is made of stainless steel.

15. A reinforced arrangement for mounting a handle pole member onto a jet ski watercraft, said handle pole member being made of thin-wall fiberglass configured to define a channel terminating in a mounting knuckle having openings adapted to receive a main pivot mounting pin, said reinforced arrangement comprising:

a pair of internal reinforcing members within and in intimate contact with the interior of said channel defined by said pole member, said internal reinforcing members extending along the interior wall of said channel, said internal reinforcing members being contoured to match the interior configuration of said channel, said internal reinforcing members each having an opening providing a bearing journal for said main pivot mounting pin;

a pair of external clamping members disposed outside of and in intimate contact with the exterior surfaces of said pole member, said external clamping members having a configuration adapted to match the external contours of said pole member;

a layer of adhesive disposed between said internal reinforcing members and the interior walls of said channel defined by said pole member;

a plurality of fasteners extending through said walls of said pole member, said layer of adhesive, and said internal reinforcing members, said fasteners applying force to compress said layer of adhesive, said walls of said pole member and said internal reinforcing members together, whereby said openings in said internal reinforcing members providing a bearing journal for said main pivot mounting pin and said pole member act as one integral unit; and a main pivot mounting pin disposed in said mounting knuckle passing through said internal reinforcing members for pivotably mounting said pole member onto the jet ski watercraft.

16. The reinforced arrangement of claim 15 in which said internal reinforcing members are made of high-density aluminum.

17. The reinforced arrangement of claim 15 in which said external clamping members are made of stainless steel.

18. The reinforced arrangement of claim 15 in which said external clamping members have a substantially flat notched triangular configuration.

19. The reinforced arrangement of claim 15 in which said adhesive is a waterproof epoxy.

20. The reinforced arrangement of claim 15 in which said fasteners are made of stainless steel.

21. The reinforced arrangement of claim 15 in which said main pivot mounting pin is made of stainless steel.

* * * * *